US007748550B2

(12) United States Patent
Cho

(10) Patent No.: US 7,748,550 B2
(45) Date of Patent: Jul. 6, 2010

(54) SANITARY DOUBLE CAP ALLOWING ADDITION OF ADJUNCT TO CONTENTS OF A CONTAINER

(75) Inventor: Young Kook Cho, 2292 Spin Drift Way, Lawrenceville, GA (US) 30043

(73) Assignee: Young Kook Cho, Marietta, GA (US)

( * ) Notice: Subject to any disclaimer, the term of this patent is extended or adjusted under 35 U.S.C. 154(b) by 1250 days.

(21) Appl. No.: 11/286,678

(22) Filed: Nov. 23, 2005

(65) Prior Publication Data

US 2006/0108314 A1 May 25, 2006

(30) Foreign Application Priority Data

Nov. 23, 2004 (KR) ..... 10-2004-0096418

(51) Int. Cl.
*B65D 25/08* (2006.01)
*B65D 51/28* (2006.01)
*B65D 41/34* (2006.01)

(52) U.S. Cl. ..... 215/228; 206/222; 215/252; 220/502; 220/521; 220/212

(58) Field of Classification Search ..... 220/501, 220/502, 521, 522, 212; 215/228, 252, 253, 215/270; 206/221, 222
See application file for complete search history.

(56) References Cited

U.S. PATENT DOCUMENTS 4,195,731 A * 4/1980 Cavazza ..... 206/222
4,793,475 A * 12/1988 Itzel ..... 206/221
4,982,875 A * 1/1991 Pozzi et al. ..... 222/83
5,029,718 A * 7/1991 Rizzardi ..... 215/254
5,038,951 A * 8/1991 Rizzardi ..... 215/256
5,474,209 A * 12/1995 Vallet Mas et al. ..... 222/83
5,782,345 A * 7/1998 Guasch et al. ..... 206/222
6,148,996 A * 11/2000 Morini ..... 206/222
6,477,743 B1 * 11/2002 Gross et al. ..... 222/525
6,840,373 B2 * 1/2005 Gibler et al. ..... 206/219
6,926,138 B1 * 8/2005 Basham et al. ..... 206/222
7,261,226 B2 * 8/2007 Adams et al. ..... 222/521
7,347,322 B2 * 3/2008 Cho ..... 206/222

(Continued)

*Primary Examiner*—Anthony Stashick
*Assistant Examiner*—Niki M Eloshway

(57) ABSTRACT

Disclosed herein is double cap having a lower cap rotatably connected to an upper cap. The lower cap has an insertion pipe body defining an adjunct receiving chamber therein. The insertion pipe body has a bottom opening covered by a bottom cover. A plurality of rib protrusions is provided on an inner surface of the insertion pipe body. First and second steps are formed on an upper end of the lower cap and stepped downward from an upper end of the adjunct receiving chamber. A push member, having a push pipe body is received in the adjunct receiving chamber of the lower cap, with a plurality of guide protrusions formed on the exterior of the push pipe body, so that the rib protrusions of the lower cap are guided by the guide protrusions to guide the upward and downward movement of the push member. External push threading is provided around a circumferential outer surface of the push member. The upper cap has internal threading provided for engagement with the external push threading formed on the push member to provide an upward and downward moving force for the push member relative to the direction of rotation of the upper cap, so that, when the upper cap is rotated in a predetermined direction, the push member moves downward to open the bottom cover.

3 Claims, 6 Drawing Sheets

U.S. PATENT DOCUMENTS

2002/0020636 A1* 2/2002 Bergamini et al. ..... 206/219
2002/0066748 A1* 6/2002 Weiler et al. ..... 222/129
2004/0226835 A1* 11/2004 Takahashi et al. ..... 206/219
2005/0161348 A1* 7/2005 Morini ..... 206/219
2005/0211579 A1* 9/2005 Makita ..... 206/219
2006/0144727 A1* 7/2006 Fontana ..... 206/222
2007/0045134 A1* 3/2007 Dvorak et al. ..... 206/222

* cited by examiner

SANITARY DOUBLE CAP ALLOWING ADDITION OF ADJUNCT TO CONTENTS OF A CONTAINER

BACKGROUND OF THE INVENTION

1. Field of the Invention

The present invention relates generally to caps having a storage means therein allowing the addition of adjuncts. More particularly, the present invention relates to a sanitary double cap allowing for the addition of an additive into the contents of a container with a relatively simple rotation of a predetermined portion of the double cap.

2. Description of the Related Art

Generally, a technique, in which medical powder or an adjunct, which have been stored in a cap of a container, is added into the container when the cap is pushed downwards, is well known. A representative example of this technique is shown in an illustration of a prior art shown in FIG. 1 through FIG. 3. As shown in FIG. 1, which is an exploded view of the prior art, contents are contained in a container, which has an open upper end. A lower cap 1 is coupled to an opening of a neck part of the container. The lower cap 1 includes an insertion part 3 which extends a predetermined length downwards from an upper end 2 of the lower cap 1 and defines an adjunct receiving chamber 4 therein. A thin film 5 forms a bottom of the insertion part 3 of the lower cap 1. A pipe body 6 of an upper cap 8 is fitted into the adjunct receiving chamber 4 of the lower cap 1. A frictional ring 7 is provided on a circumferential outer surface of the pipe body 6 of the upper cap 8.

To use the conventional cap, the upper cap, which has been in the state of FIG. 2, is pushed downwards. Then, as shown in FIG. 3, the thin film 5 that forms the bottom 11 of the insertion part 3 breaks, so that the adjunct 9, which has been in the pipe body 6 of the upper cap 8, is input into the container 12, thus forming a mixture 10.

This technique has an advantage of ease of addition of the adjunct 9. However, this technique is problematic in that, when it is desired for a user to use the mixture, it is not easy to open the lower cap 1.

Furthermore, because the state of the upper cap when pushed is not easily distinguished from the normal state of the upper cap, it is difficult for the user to determine whether the container has already been used or not.

As well, after the cap has been separated from the container and part of the mixture has been used, if the container is covered again with the cap to store remaining mixture, when the user desires to use the remaining mixture, it is not easy to open the cap, thus being inconvenient to the user.

SUMMARY OF THE INVENTION

Accordingly, the present invention has been made keeping in mind the above problems occurring in the prior art and an object of the present invention is to provide a sanitary double cap, in which both a push member, which moves downwards to break a bottom cover for release of an adjunct into a container, and a lower cap, which defines an adjunct receiving chamber therein, are covered with an upper cap, thus improving sanitary performance.

Another object of the present invention is to provide a sanitary double cap, in which security bands, are respectively provided on upper and lower caps, thus letting a user know whether an adjunct has been released by inspecting the upper cap, and letting the user know whether the contents of a container have been used by inspecting the lower cap.

A further object of the present invention is to provide a sanitary double cap, in which the adjunct contained within the double cap is released with a relatively simple rotation of the upper cap.

In order to accomplish the above objects, the present invention provides a sanitary double cap which has a structure in which a push member is placed in an adjunct receiving chamber, defined in a lower cap, such that an adjunct is added into a container by movement of the push member, and in which a lower security band, is provided below the lower end of the lower cap, and an upper security band, is provided between the lower cap and the lower end of an upper cap, and in which the lower cap has a double step structure on the upper end thereof. The push member and the upper cap are coupled to each other by a threaded engagement structure for providing upward and downward moving force for the push member, and the push member and the lower cap are coupled to each other by a rib means to ensure the upward and downward movement of the push member.

In other words, the present invention provides a sanitary double cap allowing addition of an adjunct. The double cap can be coupled to a neck part of a container to close an opening of the container. The double cap has a lower cap, having an insertion pipe body defining the adjunct receiving chamber therein, with a plurality of rib protrusions provided on an inner surface of the insertion pipe body and spaced apart from each other at regular intervals, and a bottom cover covering a bottom opening of the insertion pipe body. First and second steps are formed on an upper end of the lower cap and stepped downward from an upper end of the adjunct receiving chamber. A push member, having a push pipe body is received in the adjunct receiving chamber of the lower cap, with a plurality of guide protrusions formed on the exterior of the push pipe body, so that the rib protrusions of the lower cap are guided by the guide protrusions to guide the upward and downward movement of the push member. An external push thread is provided around a circumferential outer surface of the push member; and an upper cap surrounding the push member and the first step of the lower cap is provided to rotatably connect to the lower cap. The upper cap has internal threading provided for engagement with the external push threading formed on the push member to provide an upward and downward moving force for the push member relative to the direction of rotation of the upper cap, so that, when the upper cap is rotated in a predetermined direction, the push member moves downward to break the film hinge to open the bottom cover.

The internal threading of the upper cap engaging with the external push threading of the push member may be provided on an inner surface of a subsidiary pipe body, which extends downwards from a crown member of the upper cap.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Figure 1:
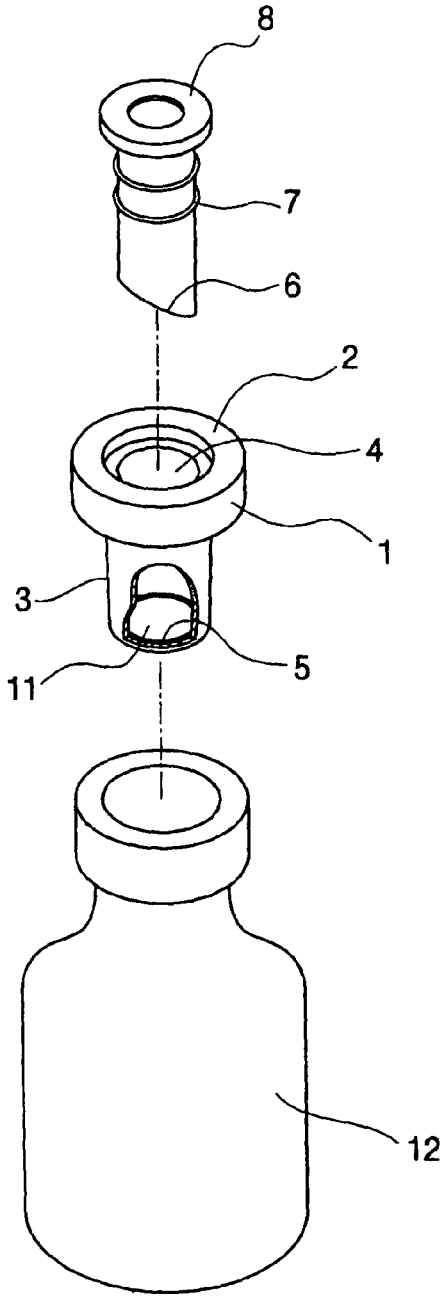
FIG. 1 Prior Art
FIG. 1 is an exploded perspective view showing a representative example of a prior art conventional double cap.
Figure 2:
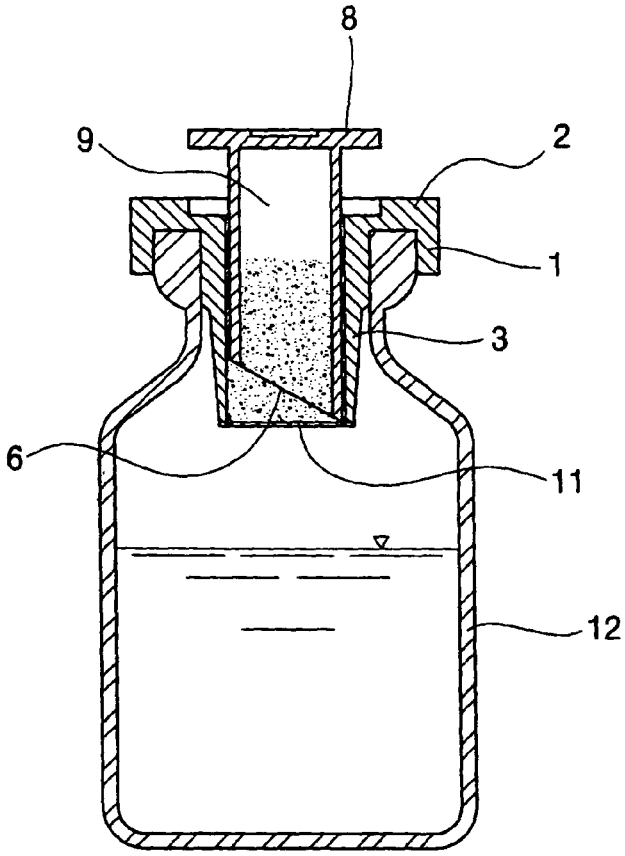
FIG. 2 Prior Art
FIG. 2 is a cross-sectional view showing the double cap of FIG. 1 coupled to a bottle.
Figure 3:
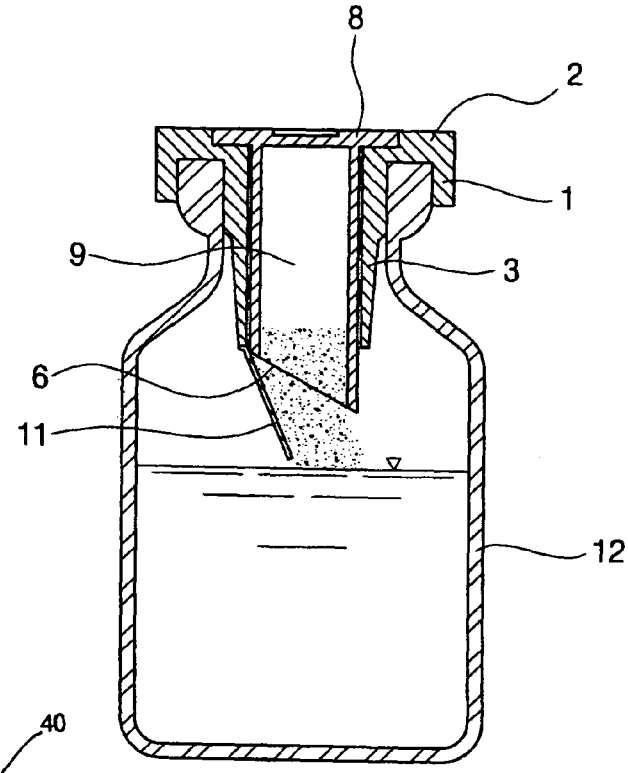
FIG. 3 Prior Art
FIG. 3 is a cross-sectional view showing usage of the double cap of FIG. 2.

Hereinafter, a first embodiment of the present invention will be described in detail with reference to the attached drawings.

As shown in the drawings, the sanitary double cap allowing the addition of an adjunct according to the first embodiment of the present invention has an adjunct receiving chamber 24 defined at a center thereof and is coupled to a neck part of a container 12 to close an opening of the container 12. A bottom cover 29 is coupled at an outside edge thereof to a lower end of the adjunct receiving chamber 24 of the lower cap 20 by a film hinge 28. Thus, when the push member 40 is moved downwards, the film hinge 28 is cut by the push member 40.

In detail, the double cap of the present invention includes the lower cap 20 which has an insertion pipe body 24-1 that defines therein the adjunct receiving chamber 24, into which a push pipe body 42 of the push member 40 is inserted. The insertion pipe body 24-1 has a bottom opening 55, which is covered by the bottom cover 29. The bottom cover 29 can be of any type known in the prior art, which is suitable for covering a bottom opening without leakage. The bottom cover 29 can be, but is not limited to, a stopper, a film of material, a sheet of foil material, or a layer of sealing material. In the illustrations shown, the bottom cover 29 is coupled at an outside edge thereof to a lower end of the adjunct receiving chamber 24 of the lower cap 20 by a film hinge 28.

First and second steps 25 and 26 are provided on an upper end of the lower cap 20 and are stepped downwards from an upper end of the adjunct receiving chamber 24. Rib protrusions 24-2 are provided on an inner surface of the insertion pipe body 24-1 and are spaced apart from each other at regular intervals.

The sanitary double cap further includes the push member 40 which has guide protrusions 43 that are formed on an outer surface of the push pipe body 42, so that the rib protrusions 24-2 of the lower cap 20 are guided by the guide protrusions 43 of the push member 40 as the push member 40 moves upward and downward. An external push threading 41 is provided around a circumferential outer surface of the push member 40 to provide upward and downward moving force for the push member 40.

Figure 4:
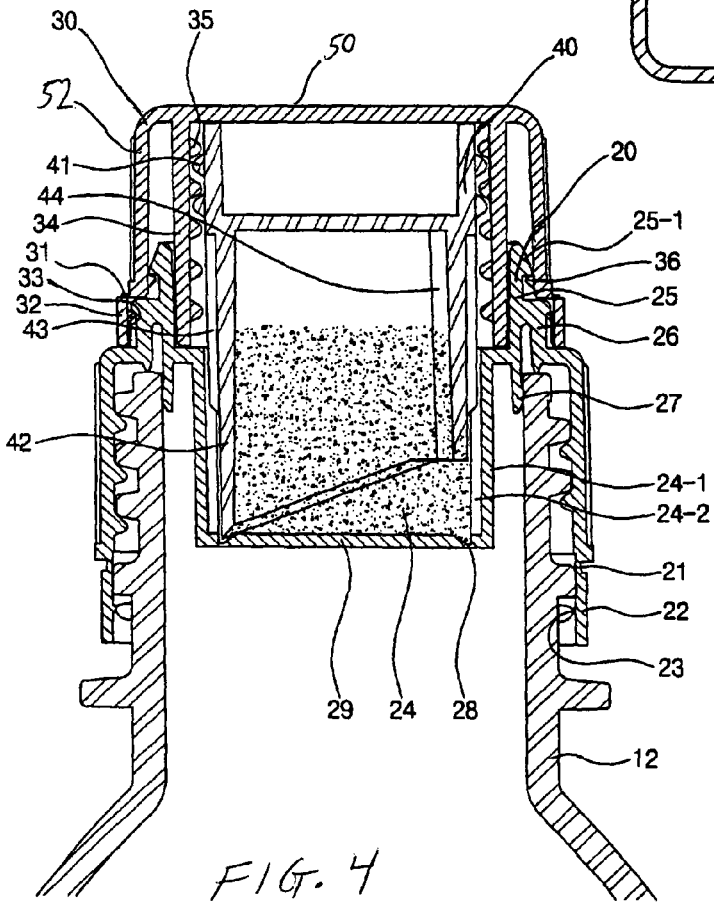
FIG. 4 is a cross-sectional view of an assembled double cap, according to a first embodiment of the present invention.
Figure 5:
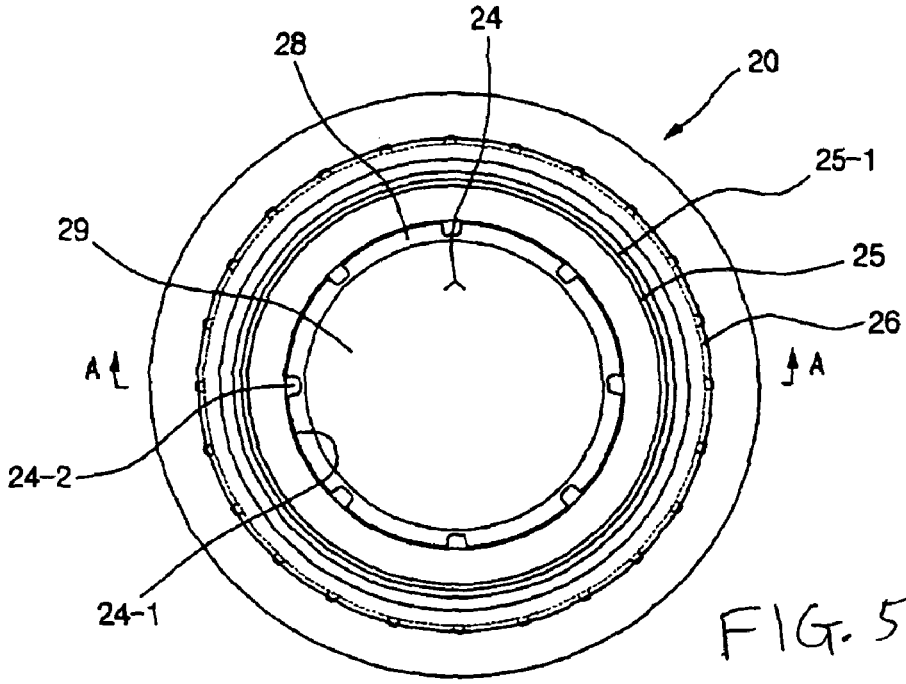
FIG. 5 is a top plan view of a lower cap of the double cap of FIG. 4.
Figure 6:
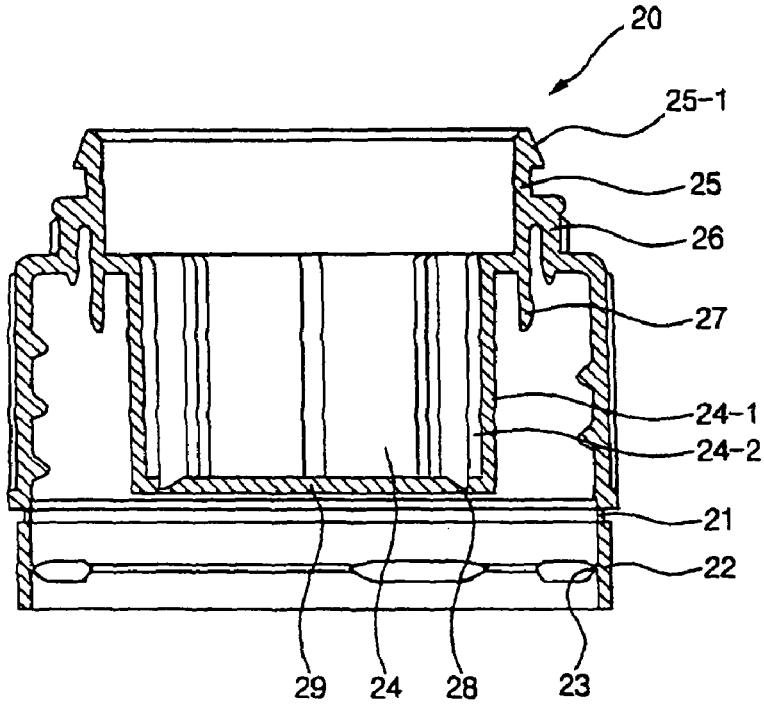
FIG. 6 is a cross-sectional view taken along line A-A of FIG. 5.
Figure 7:
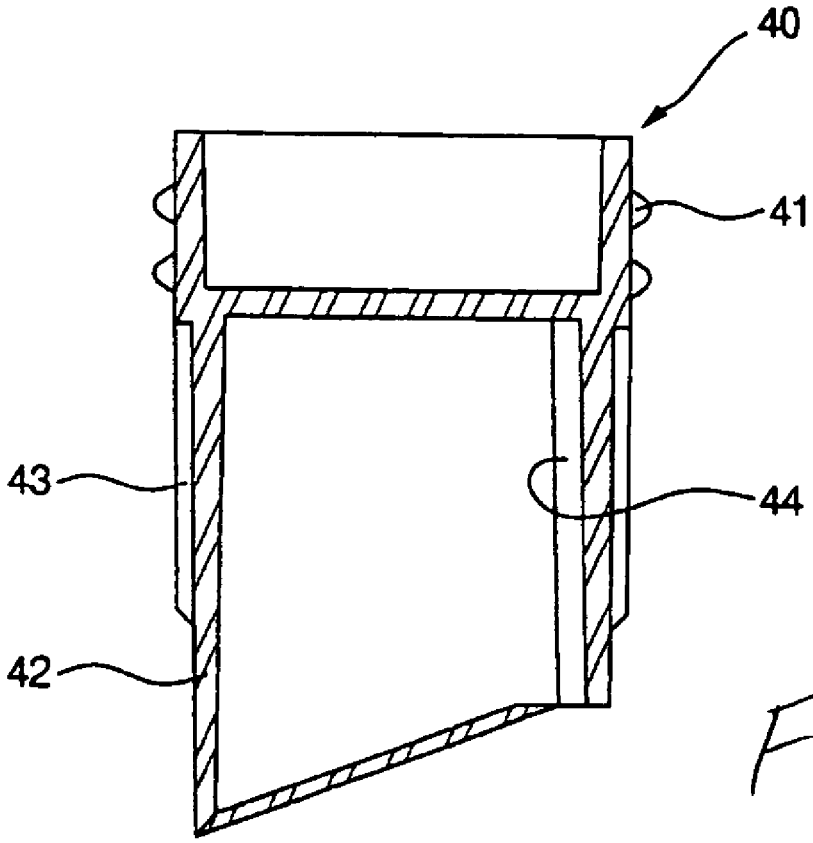
FIG. 7 is a longitudinal cross-sectional view of a push member of the double cap of FIG. 4.
Figure 8:
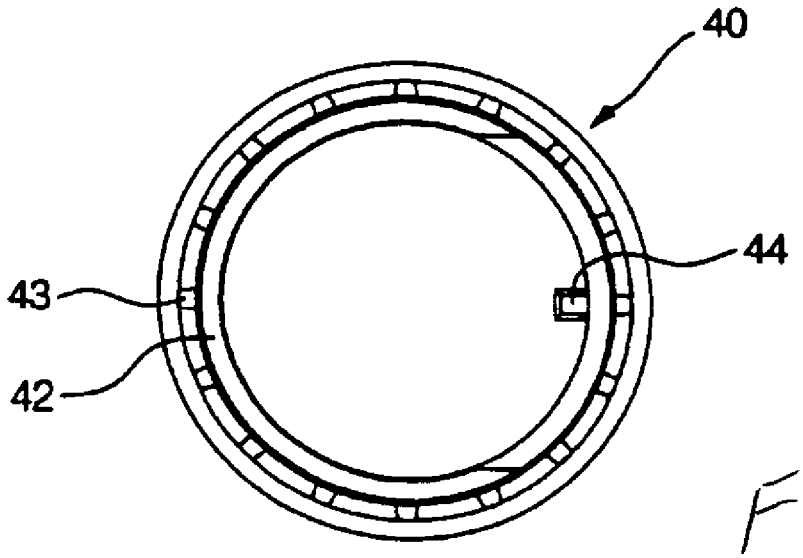
FIG. 8 is a bottom plan view of the push member of FIG. 7.

The sanitary double cap further includes an upper cap 30 which surrounds the push member 40 and the first step 25 of the lower cap 20. The upper cap 30 has a crown member 50 having an outer wall 52 extending downward from the crown member 50. Also, a subsidiary pipe body 34 extends downward from the crown member 50 inward from the outer wall 52. The subsidiary pipe body 34 extends downwards so that it extends to at least the first step 25 when the upper cap 30 is connected to the lower cap 20. The upper cap 30 has internal threading 35 provided within the upper cap 30 that engages with the external push threading 41 of the push member 40, so that, when the upper cap 30 is rotated, the push member 40 is moved upwards or downwards relative to the direction of rotation of the upper cap 30. As shown in FIG. 4, the internal threading 35, which engages with the external push threading 41 of the push member 40, is provided on the inner surface of the subsidiary pipe body 34.

The internal threading 35 of the inner surface of the subsidiary pipe body 34 has a predetermined length such that the downward movement of the push member 40 for a predetermined distance necessary to cut the film hinge 28 of the bottom cover 29 is ensured by the engagement between the internal threading 35 of the subsidiary pipe body 34 and the external push threading 41 of the push member 40.

Furthermore, at least one stopper 44 protrudes a predetermined length from the inner surface of the push pipe body 42 of the push member 40 to prevent part of the bottom cover 29 from being held in the push pipe body 42 when the push member 40 breaks the film hinge 28.

An inner sealing protrusion 27 is provided in the lower cap 20 between a lower end of an inner wall of the second step 26 and the insertion pipe body 24-1 to provide a seal between the inner surface of the opening of the container 12 and the lower cap 20.

In the present invention having the above-mentioned structure, the push member 40 is first coupled to the upper cap 30 such that the external push thread 41 of the push member 40 engages with the internal thread 35 of the upper cap 30. In this state, an adjunct (including but not limited to a powdered, liquid, or granular adjunct) is received in a space defined by the push pipe body 42 of the push member 40. Thereafter, the lower cap 20 is coupled to the upper cap 30 such that 1.) the first step 25 of the lower cap 20 is inserted into a space defined outside the subsidiary pipe body 34 of the upper cap 30 and 2.) the lower end of the push member 40 is inserted into the adjunct receiving chamber 24.

Subsequently, the opening of the container 12, which contains contents, is capped with the double cap constructed by integrally assembling the lower cap 20, which is filled with the adjunct, the upper cap 30, and the push member 40. Thereafter, the capped container 12 is marketed after having passed through a sterilization process.

To use the container 12, a user rotates the upper cap 30 in a predetermined direction necessary to move the push member 40 downward. Then, an upper security band 32, having knurling 33 formed on an interior surface thereof, can be provided around the lower edge of the upper cap 30 around the area of engagement between the upper cap 30 and lower cap 20. The upper security band 32 is formed to maintain the original position of the upper cap 30 due to a coupling force generated between the first step 25 and knurling 33 on the security band 32. The upper security band 32 can also have a breakable connection member 31 joining the upper security band 32 to the upper cap to prevent undesired rotation of the upper cap 30 prior to usage. The connection member 31 can be broken from the upper cap 30 with the application of at least a predetermined amount of rotational force on the upper cap 30. Once the connection member 31 is broken from the upper cap 30, the upper cap 30 can rotate. Meanwhile, a hook 36 can be provided to protrude from the inner surface of the lower end of the outer wall 52 of the upper cap 30, and a hooking portion 25-1 can be provided on the first step 25 of the lower cap 20 at a position corresponding to the hook 36. Thus, the hook 36 and hooking protrusion 25-1 hooks keeps the upper cap 30 hooked onto the lower cap 20. Therefore, even when the upper cap 30 is rotated, the upper cap 30 remains in place.

Figure 9:
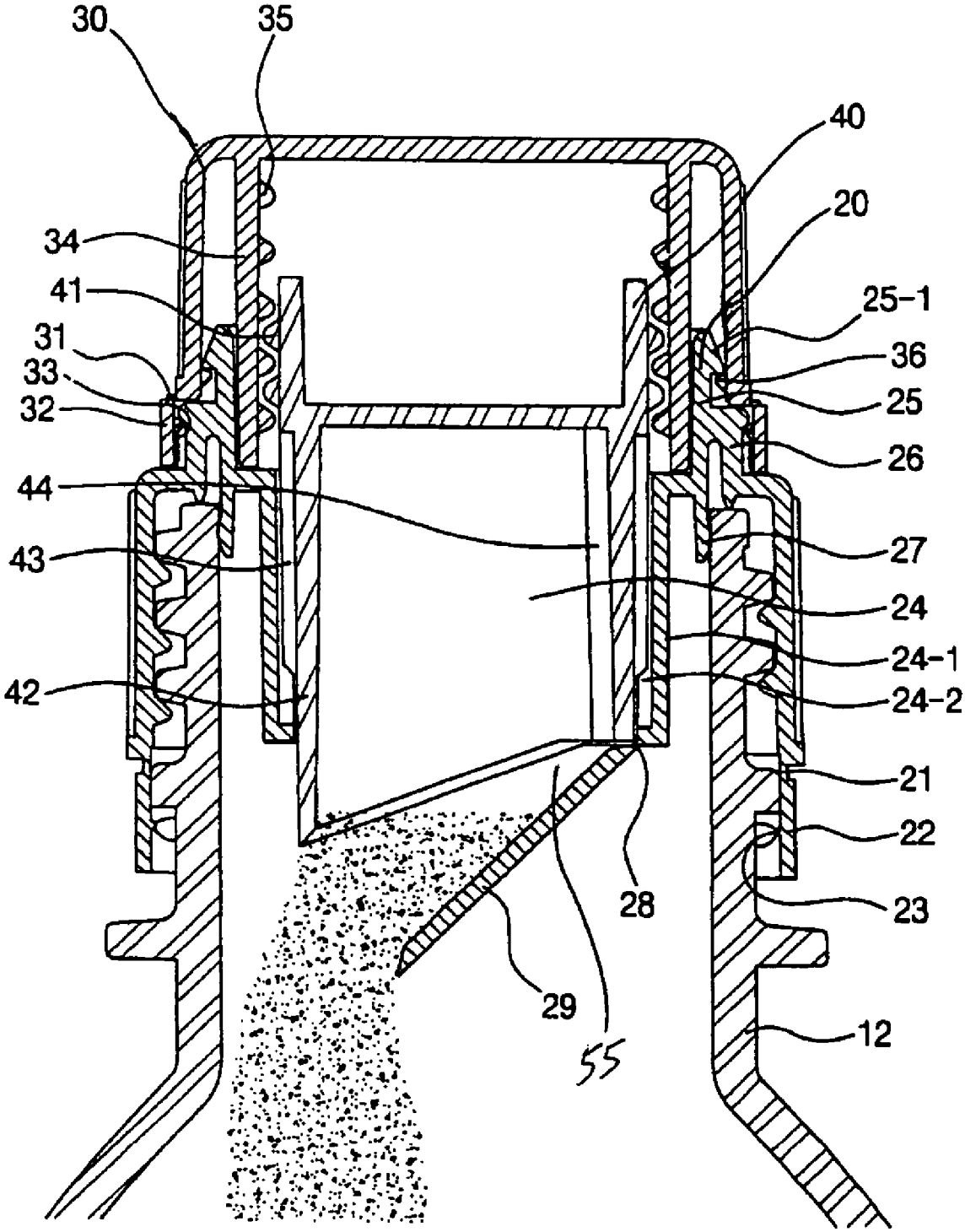
FIG. 9 is an assembled cross-sectional view showing usage of the double cap of FIG. 4.

Furthermore, due to the rotation of the upper cap 30, the external push threading 41, which engages with the internal threading 35 of the subsidiary pipe body 34 may have a tendency to rotate along with the upper cap 30. However, because the guide protrusions 43, which are formed in the outer surface of the push pipe body 42, and the rib protrusions 24-2, which are provided on the inner surface of the insertion pipe body 24-1, engage with each other, the push member 40 moves downward without being rotated. Then, the lower end of the push pipe body 42 of the push member 40 cuts the film hinge 28 to separate at least a portion of the bottom cover 29 from the bottom of the insertion pipe body 24-1 to expose the bottom opening 55. Simultaneously, the adjunct freely falls into the container 12, as shown in FIG. 9, and is then mixed with the contents in the container 12.

Subsequently, the user shakes the container 12 to sufficiently mix the adjunct with the contents. Thereafter, the user can separate a lower security band 22 from the lower cap 20. Here, the lower security band 22 may have a structure such that, when the user pulls a grip (not shown) of the lower security band 22, it is removed from the lower cap 20. Alternatively, the lower security band 22 may have knurling formed, so that, when the user rotates the lower cap 20, a lower security band connection member 21 connecting the lower security band 22 to the lower cap 20, can break. As such, when the lower security band 22 is separated from the lower cap 20 and the lower cap 20 is released and opened by rotation, the push member 40, which is inserted into the adjunct receiving chamber 24 of the lower cap 20, is also opened. Thus, the user may drink the contents, mixed with the adjunct, trough the opening of the container 12.

As described above, in the sanitary double cap of the present invention, both a push member, which is moved downwards by rotation of an upper cap and thus breaks a bottom cover so that an adjunct is added into a container, and a lower cap, which has an adjunct receiving chamber therein, are covered by the upper cap. Therefore, the present invention has improved sanitary performance even when the container is carried.

Also, with the security bands, on the respective upper and lower caps, a user can know whether an adjunct has been released by inspecting the upper cap and whether the contents of a container have been used by inspecting the lower cap. In addition, the upper cap is constructed such that, when the upper cap is rotated on the upper cap, it remains in place. The upper cap and the push member are coupled to each other by the thread engagement structure, so that, when the upper cap is rotated in a predetermined direction, the push member is moved downwards. As such, even if the user does not perform a separate adjunct addition process, the adjunct can be automatically added, thus being convenient for the user.

Figure 10:
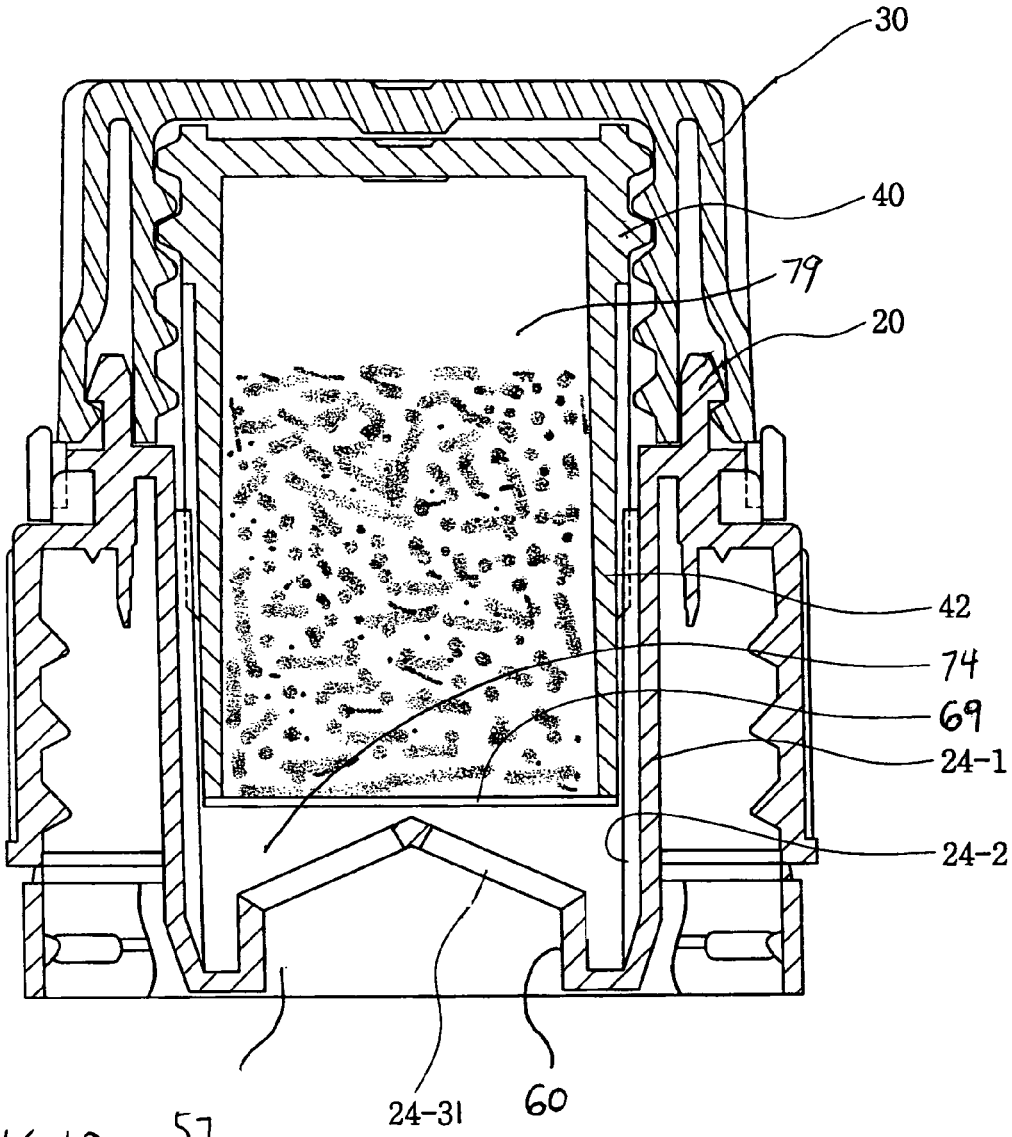
FIG. 10 is a view showing an assembled double cap, according to a second embodiment of the present invention; and, FIG. 10*a* is an isolated top plan view of the bottom piercing member of the second embodiment of the present invention.
Figure 10A:
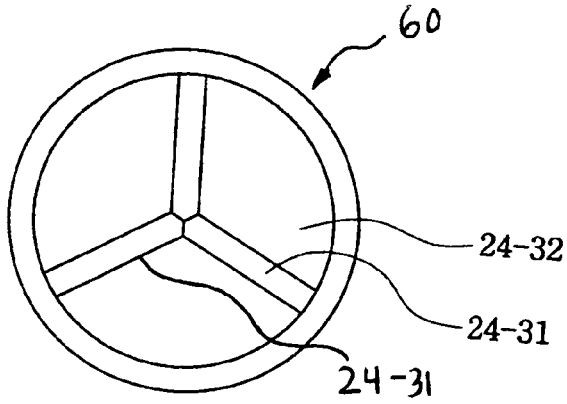

FIG. 10 shows a double cap according to a second embodiment of the present invention. In this embodiment, a lower cap 20 has an insertion pipe body 24-1 defining a pipe body receiving chamber 74 therein. Also, the insertion pipe body 24-1 has a bottom opening 57. In this embodiment, the insertion pipe body 24-1 no longer defines an adjunct receiving chamber of the first embodiment. A bottom piercing member 60 connects to the insertion pipe body 24-1 over the bottom opening 57 of the insertion pipe body 24-1. An isolated view of the bottom piercing member 60 is shown in FIG. 10*a*. The bottom piercing member 60 has breaking ribs 24-31 and several adjunct passing apertures 24-32. Also, in this embodiment, the push member 40 has an open bottom end, and a cover 69 covers the open bottom end of the push member 40. With the open bottom end covered, the push member defines a storage chamber 79 therein suitable for containing an adjunct. The upper cap 30 is engaged to the push member 40 in a manner so that rotation of the upper cap 30 in a predetermined direction pushes the push member 40 downward to cause the cover 69 at the bottom end of the push member 40 to be pierced by bottom piercing member 60 of the insertion pipe body 24-1. When the cover 69 of the push member 40 is pierced, the adjunct stored in the push member 40 falls into the container through the adjunct passing apertures 24-32. The general construction and operation of the second embodiment, other than the above-mentioned structure, remain the same as the first embodiment, therefore further explanation is deemed unnecessary.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A double cap for use with a container, said container having a neck and an opening leading into the container, said double cap comprising: a lower cap having an insertion pipe body, said insertion pipe body defining an adjunct receiving chamber therein, said insertion pipe body having a bottom opening, a bottom cover covering the bottom opening of the insertion pipe body; an upper cap rotatably connected to the lower cap; a push member disposed in the adjunct receiving chamber of the lower cap; the upper cap engaged to the push member in a manner so that rotation of the upper cap in a predetermined direction pushes the push member downward to cause at least a portion of the bottom cover to be removed from the bottom of the insertion pipe body to expose said bottom opening; further comprising: a plurality of rib protrusions provided on an inner surface of the insertion pipe body; a plurality of guide protrusions provided on an outer surface of the push member, and, wherein the rib protrusions and guide protrusions are formed and positioned to guide the upward and downward movement of the push member.

2. A double cap for use with a container, said container having a neck with an external threading and an opening leading into the container, said double cap comprising: a lower cap having an insertion pipe body, said insertion pipe body defining an adjunct receiving chamber therein, said insertion pipe body having a bottom opening, internal threading formed on an inner surface of the lower cap for engagement with the external threading of the container; a first step and second step formed on an upper end of the lower cap; a bottom cover covering the bottom opening of the insertion pipe body; an upper cap rotatably connected to the lower cap, said upper cap having a crown member and an outer wall extending downward from said crown member; a subsidiary pipe body extending downward from the crown member inward from the outer wall; a push member disposed in the adjunct receiving chamber of the lower cap and within the subsidiary pipe body of the upper cap; and, the upper cap engaged to the push member in a manner so that rotation of the upper cap in a predetermined direction pushes the push member downward to cause at least a portion of the bottom cover to be removed from the bottom of the insertion pipe body to expose said bottom opening; further comprising: a plurality of rib protrusions provided on an inner surface of the insertion pipe body; a plurality of guide protrusions provided on an outer surface of the push member; and, wherein the rib protrusions and guide protrusions are formed and positioned to guide the upward and downward movement of the push member.

3. A double cap for use with a container, said container having a neck and an opening leading into the container, said double cap comprising: a lower cap having an insertion pipe body, said insertion pipe body defining a pipe body receiving chamber therein, said insertion pipe body having a bottom opening, a bottom piercing member provided at the bottom opening of the insertion pipe body, said bottom piercing member having several adjunct passing apertures; an upper cap rotatably connected to the lower cap; a push member disposed in the pipe body receiving chamber of the lower cap; said push member having an open bottom end; a cover covering the open bottom end of the push member to define a storage chamber within said push member; the upper cap engaged to the push member in a manner so that rotation of the upper cap in a predetermined direction pushes the push member downward to cause the cover at the bottom end of the push member to be pierced by bottom piercing member of the insertion pipe body; further comprising: a plurality of rib protrusions provided on an inner surface of the insertion pipe body; a plurality of guide protrusions provided on an outer surface of the push member; and, wherein the rib protrusions and guide protrusions are formed and positioned to guide the upward and downward movement of the push member.

* * * * *